US006224432B1

(12) United States Patent
Billman

(10) Patent No.: US 6,224,432 B1
(45) Date of Patent: May 1, 2001

(54) ELECTRICAL CONTACT WITH ORTHOGONAL CONTACT ARMS AND OFFSET CONTACT AREAS

(75) Inventor: Timothy B. Billman, Dover, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/473,771

(22) Filed: Dec. 29, 1999

(51) Int. Cl.[7] ..... H01R 11/22
(52) U.S. Cl. ..... 439/856; 439/857
(58) Field of Search ..... 439/849, 856, 439/857, 858, 861, 290

(56) References Cited

U.S. PATENT DOCUMENTS

| | | | | |
|---|---|---|---|---|
| Re. 30,277 | * | 5/1980 | Simmons | 339/74 |
| 3,514,740 | * | 5/1970 | Filson | 439/290 |
| 3,555,493 | | 1/1971 | Baumanis | 339/176 |
| 3,634,811 | * | 1/1972 | Teagno | 339/47 |
| 3,862,792 | * | 1/1975 | Jayne | 339/93 |
| 4,004,845 | * | 1/1977 | Sochor | 339/258 |
| 4,175,821 | | 11/1979 | Hunter | 339/258 R |
| 4,226,499 | | 10/1980 | Bauerle | 339/258 R |
| 4,379,611 | | 4/1983 | Foege et al. | 339/217 |
| 4,557,548 | | 12/1985 | Thrush | 339/258 P |
| 4,591,230 | * | 5/1986 | Roldan | 339/258 |
| 4,607,907 | | 8/1986 | Bogursky | 339/258 P |
| 4,776,651 | * | 10/1988 | Paulo | 439/857 |
| 4,973,273 | | 11/1990 | DePriest | 439/856 |
| 5,030,107 | * | 7/1991 | Moon | 439/62 |
| 5,060,372 | * | 10/1991 | Capp et al. | 29/883 |
| 5,082,459 | | 1/1992 | Billman et al. | 439/637 |
| 5,106,329 | * | 4/1992 | Maeshima et al. | 439/851 |
| 5,213,530 | | 5/1993 | Uratsuji | 439/268 |
| 5,252,097 | | 10/1993 | Lindeberg et al. | 439/856 |
| 5,417,596 | * | 5/1995 | Kusakabe | 439/857 |
| 5,435,757 | * | 7/1995 | Fedder et al. | 439/686 |
| 5,458,513 | | 10/1995 | Matsuoka | 439/857 |
| 5,480,316 | | 1/1996 | Kinross et al. | 439/326 |
| 5,672,084 | | 9/1997 | Feldman | 439/852 |
| 5,676,570 | | 10/1997 | Scherer | 439/787 |
| 5,685,748 | | 11/1997 | Harting et al. | 439/862 |
| 5,695,352 | * | 12/1997 | Abe | 439/223 |
| 5,711,690 | | 1/1998 | Thrush et al. | 439/862 |
| 6,050,863 | * | 4/2000 | Noda | 439/856 |

FOREIGN PATENT DOCUMENTS

WO 00/10233 2/2000 (WO) .

* cited by examiner

*Primary Examiner*—Lincoln Donovan
*Assistant Examiner*—Thanh-Tâm Lê
(74) *Attorney, Agent, or Firm*—Perman & Green, LLP

(57) ABSTRACT

An electrical contact usable in an electrical connector and comprising a first contact arm having a first contact area; and a second contact arm having a second contact area. The first and second contact arms form a male contact receiving area therebetween. The first and second contact arms are generally orthogonal to each other with a relatively narrow side edge of the second contact arm forming the second contact area and facing a relatively wide side face of the first contact arm which forms the first contact area.

19 Claims, 7 Drawing Sheets

ELECTRICAL CONTACT WITH ORTHOGONAL CONTACT ARMS AND OFFSET CONTACT AREAS

BACKGROUND OF THE INVENTION

1. Field of the Invention

The present invention relates to electrical contacts and, more particularly, to an electrical contact with orthogonal contact arms and offset contact areas.

2. Brief Description of Earlier Developments

U.S. Pat. No. 5,711,690 discloses a card edge connector having an electrical contact with two orthogonally bent contact arms and offset contact areas between the two arms. U.S. Pat. No. 4,607,907 discloses an electrical contact with generally parallel, but offset contact portions which overlap in a path of insertion of a male pin between the two contact areas. A problem with conventional electrical contacts which are intended to receive a mating male contact is that contact arm deflection can vary too much to be efficiently used in electrical connectors with very small spacings or pitch between contacts. In addition, insertion forces of a male contact between two contact arms in a very small contact pitch connector cannot be too large, which might result in damage to the contacts, but contact wipe between the contacts and contact force between the contacts needs to be sufficient to establish a good electrical mating between the contacts. Thus, there is a need for an electrical contact which can be used in very small contact pitch connectors which has good contact wipe characteristics, relatively low mating force characteristics, and good electrical contact with a mating male contact.

SUMMARY OF THE INVENTION

In accordance with one embodiment of the present invention, an electrical contact is provided comprising a first contact arm having a first contact area; and a second contact arm having a second contact area. The first and second contact arms form a male contact receiving area therebetween. The first and second contact arms are generally orthogonal to each other with a relatively narrow side edge of the first contact arm forming the first contact area and facing a relatively wide side face of the second contact arm which forms the second contact area.

In accordance with another embodiment of the present invention, an electrical contact is provided comprising a first connection section for connection to a first electrical component; and a second connection section, connected to the first connection section, for connection to a second electrical component. The second connection section comprises two contact arms forming a male contact receiving area therebetween. The two contact arms each have a male contact contacting area which are longitudinally offset from each other along a path of insertion of the male contact into the contact receiving area. Before the male contact is inserted into the contact receiving area, the two contacting areas overlap each other through the path of insertion of the male contact.

In accordance with one method of the present invention, a method of manufacturing an electrical contact is provided comprising steps of providing a one-piece member with a first section having two contact arms; forming a first contact area on a first relatively narrow face of a first one of the contact arms, and a second contact area on a second relatively wide face of a second one of the contact arms; and bending the one-piece member to locate the two contact arms into a general orthogonal position relative to each other such that the first and second faces are located opposite each other and form a male contact receiving area therebetween.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
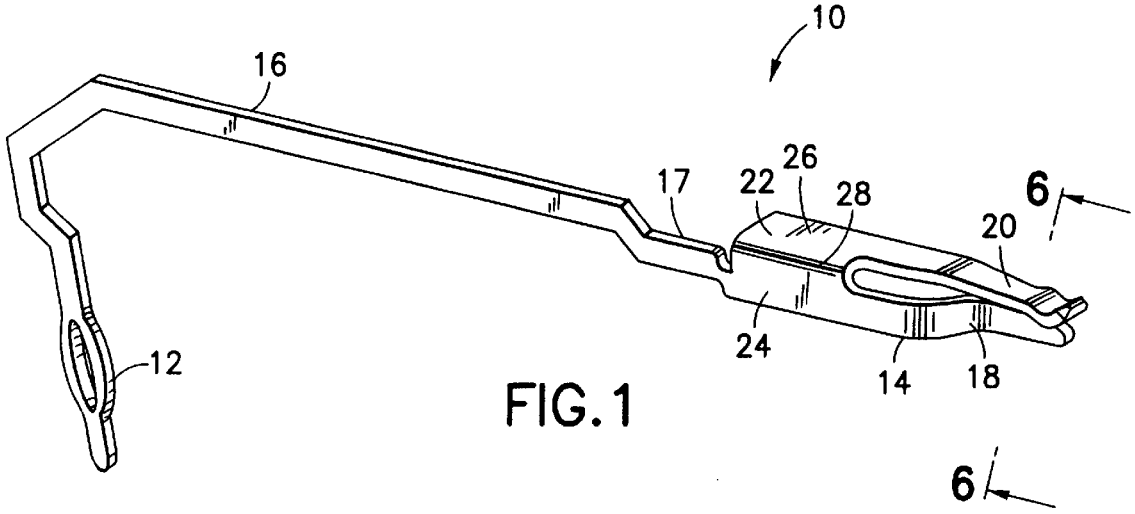
FIG. 1 is a perspective view of an electrical contact incorporating features of the present invention.

Referring to FIG. 1, there is shown a perspective view of an electrical contact 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The contact 10 generally comprises a first connection or mounting section 12, a second connection or mating section 14, and a middle section 16 therebetween. In this embodiment the contact 10 is a one-piece member preferably stamped and formed from a flat conductive member, such as from a sheet of copper alloy. However, the contact could be comprised of more than one member and/or could be formed in any suitable manner and/or from any suitable stock material. The first connection section 12 is a press-fit through-hole solder tail. However, any suitable first connection section could be provided, such as a surface mount solder tail. The middle section 16 can have any suitable length and shape. In this embodiment the middle section 16 has a series of angled sections to form a right turn shape for use in a right angle connector, but the middle section could have a straight shape for a vertical or straight connector. In this embodiment the middle section 16 has a bent section 17 to locate the middle section 16 a selected distance from other middle sections 16 of adjacent contacts 10 in a connector. However, the first connection section 12 and the middle section 16 could have any suitable shape.

The second connection section 14 generally comprises two contact arms 18,20 connected to each other by a base 22.

Figure 2:
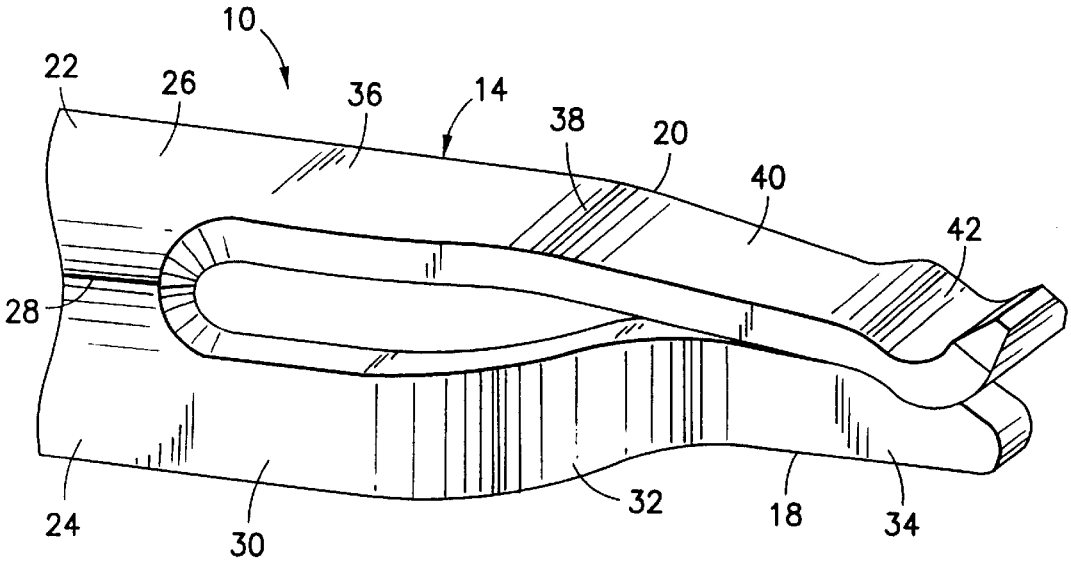
FIG. 2 is an enlarged perspective view of one end of the contact shown in FIG. 1.
Figure 3:
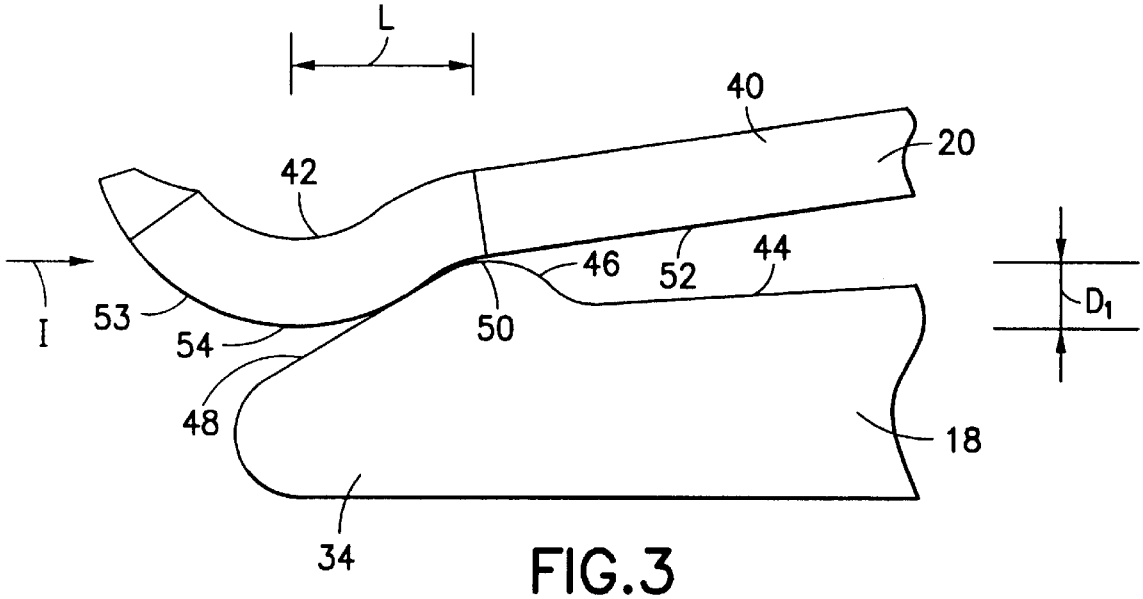
FIG. 3 is a side elevational view of the front end of the contact shown in FIG. 2.
Figure 4:
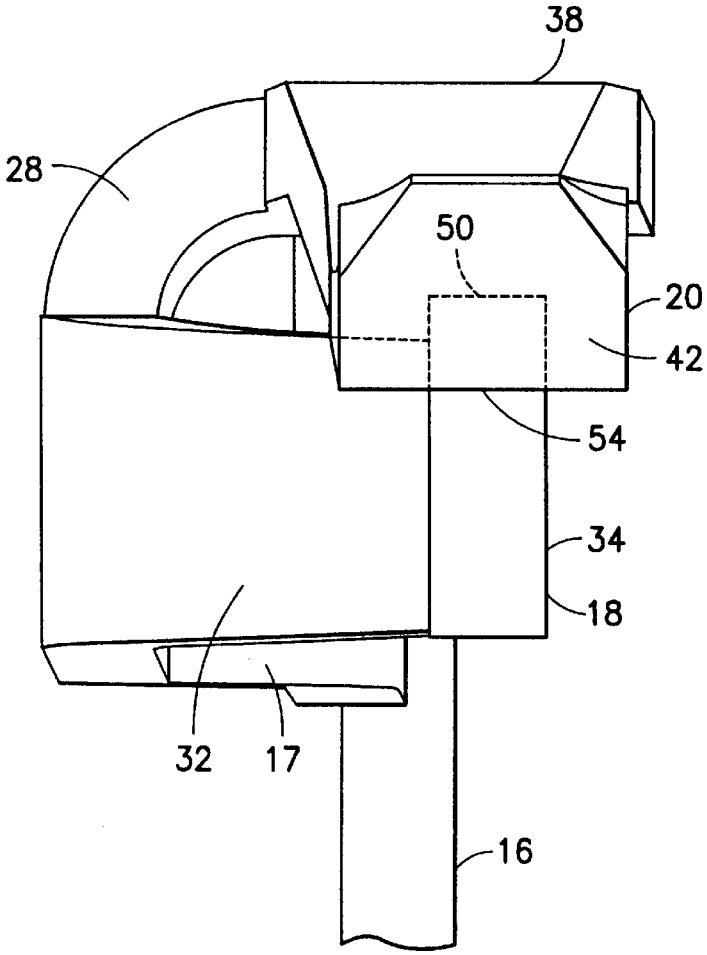
FIG. 4 is a front elevational view of the contact shown in FIG. 1.
Figure 6:
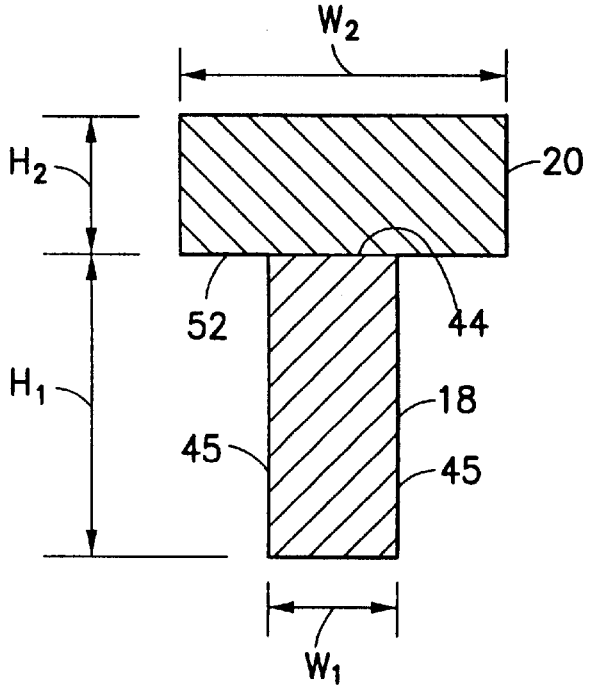
FIG. 6 is a cross-sectional view of the end of the contact shown in FIG. 1 taken along line 6—6.
Figure 7:
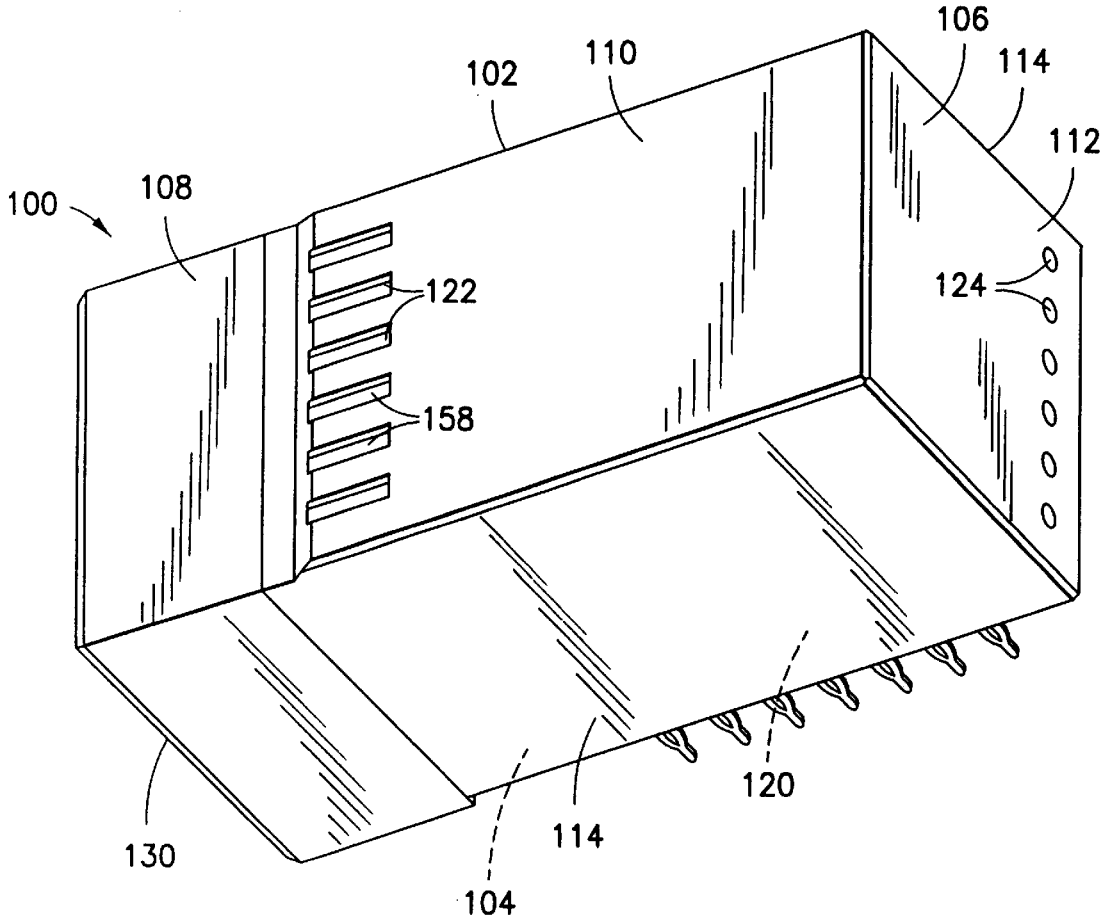
FIG. 7 is a perspective view of one embodiment of an electrical connector comprising the electrical contact shown in FIG. 1.

In alternate embodiments the second connection section could have more than two contact arms. In addition, the base 22 need not be provided, such as when the contact arms project directly off of the middle section 16. Referring also to FIG. 2, in this embodiment the base 22 has a general cross-sectional "L" shape with two sections 24,26 connected to each other at a 90° bend or corner 28. The first section 24 preferably extends directly from and parallel with the middle section 16. However, in an alternate embodiment the second section 26 and/or the corner 28 could extend directly from the middle section. The bend 28 could also be more or less than 90°. Referring also to FIGS. 3, 4 and 6, the two contact arms 18,20 extend from the base 22 in a general cantilever fashion. The first contact arm 18 generally comprises, in series, a section 30 extending from the first section 24 of the base 22, a bend 32, and a front contact section 34. The second contact arm 20 generally comprises, in series, a section 36 extending from the second section 26 of the base 22, a bend 38, a section 40, and a front contact section 42. The bend 32 in the first arm 18 locates the front contact section 34 of the first contact arm directly under the section 40 and front contact section 42 of the second contact arm 20. The first arm's front contact section 34 generally comprises a top side 44 having a protrusion 46 and a lead-in surface 48. The sloped surface leads to a male contact contacting area 50 on the protrusion 46. Because of the flat nature of the stock material (such as sheet metal) which can be used to form the contact 10, the first arm's front contact section 34 can have a relatively narrow width $W_1$, and a relatively tall height $H_1$. The second arm 20, on the other hand, because of the 90° bend 28, has a relatively wide width $W_2$ and a relatively short height $H_2$. In this embodiment H. is equal to $W_1$.

The bend 38 in the second contact arm 20 angles the section 40 toward the protrusion 46. The second arm's front contact section 42 generally comprises a formed curved shape with bottom surface 52 having a male contact contacting area 54. The curvature at the front end 53 of the bottom surface 52 forms a cam surface to interact with a mating male contact. The two contacting areas 50,54 are offset from each other by a length L relative to the insertion path of the male contact through the front end of the contact 10. The bend 38 in the second contact arm 20 preferably results in the second contact arm 20 being biased or preloaded against the first contact arm 18. However, in an alternate embodiment a preload need not be provided. In this embodiment, with the contact arms 18,20 in the home state shown in FIGS. 2–4, the bottom surface 52 of the second contact arm 20 contacts the top surface 44 of the first contact arm 18 on the sloped surface 48. However, any suitable contact points could be provided. Alternatively, the arms 18, 20 need not contact each other in the home state.

Figure 5:
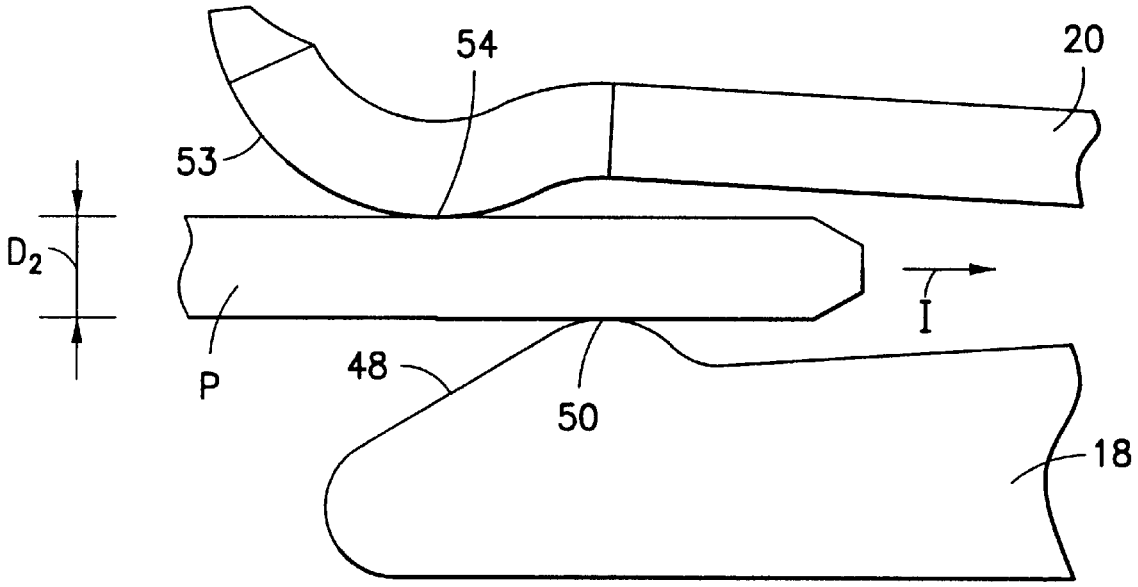
FIG. 5 is a side elevational view of the front end of the contact as shown in FIG. 3 with a male contact inserted between the two contact arms.

Referring also to FIG. 5, the two contact arms 18,20 are shown with a mating male contact P, such as a pin. The pin P can be inserted between the two arms 18,20 in a longitudinal path or direction of insertion I. The pin P has a height or width $D_2$. As the pin P is inserted through the front end of the contact 10, it contacts the surfaces 48,53 and cams the arms 18,20 apart until the pin P can slide between the two contacting areas 54,50. As seen in FIG. 3, the curvature of the second contact arm's front contact area 42, and the protrusion 46 and sloped surface 48 on the first contact arm 18 provide an overlap distance $D_1$ wherein the contacting area 54 is located below the contacting area 50. Thus, the two contacting areas overlap each other through the intended path I of insertion of the male contact P between the two contact arms. When the male contact P is inserted between the two arms 18,20, the arms 18,20 must be moved relative to each other a combined distance of $D_1$ and $D_2$. Thus, the present invention provides an increased beam or arm deflection; more than a deflection merely equal to the male contact's width $D_2$. As seen in FIG. 5, arms 18, 20 engage opposing sides of male contact P.

The orthogonal arrangement of the arms 18,20 also provides for a more predictable arm or beam deflection when the male contact P is inserted. The height $H_1$ of the first contact arm 18 is relatively larger than the height $H_2$ of the second contact arm 20. Therefore, the second arm 20 will deflect more than the first arm 18 when the male contact P is inserted. The height $H_1$ of the first arm 18 can be easily selected when the first arm 18 is initially stamped and formed to provide any suitable deflection differential between the two arms 18,20. In one embodiment the first arm 18 could be sized and shaped to have almost no deflection when the male contact P is inserted. In alternate embodiments, $H_1$ could be less than $H_2$, or $H_1$ could be equal to $H_2$. However, $W_1$ and $H_2$ are preferably constant based upon the thickness of the stock material. Thus, positioning of the male contact P between the two arms 18,20 can be more precisely controlled which can be beneficial in electrical connectors with a relatively small contact pitch, such as 1 mm or less.

The present invention also provides another advantage. By using the relatively narrow side edge 44 of the first contact arm 18 to form the contacting area 50 a greater amount of force can be exerted against a smaller area on the male contact than could otherwise be exerted by the broader side faces 45. Thus, there is no need to coin a curvature onto the area 50. The area 50 can be cross-sectionally flat. However, the area 50 could be coined if an even higher contact force is desired. The area 54 could also be coined to form a contact curvature if desired. In this embodiment, edge 44 is a cut or stamped edge. Thus, it is relatively easy to form the edge 44 with any suitable male contact contacting surface or shape at the same time that arm 18 is being stamp formed. In the embodiment shown the two arms 18,20 form a general cross-sectional "T" shaped interface. In the embodiment shown, the bottom beam is an "edge of stock" feature while the top beam is a formed feature. Although this orthogonal contact design is a departure from standard dual opposing beam technology, the overlapping geometry proves redundant contact points. The combination of $D_1$ and $D_2$ illustrates the increased deflection created by the contact beam geometry. This deflection range and corresponding mating force can be modified to meet the specific needs of different applications by modifying the beam/arm geometry. The contact arms 18, 20 could be sized and shaped such that forces against the arms, exerted by an inserted male contact, cancel each other out. Therefore, total forces on a connector housing in which the contact is mounted are counteracted. If the forces on individual contacts do not cancel each other out, each contact could be arranged relative to another contact such that the "T" shaped interfaces are in opposite positions. Thus, the combined forces could counteract each other.

Referring now to FIGS. 7, 8A, 8B, 8C and 8D, one embodiment of an electrical connector 100 having electrical contacts incorporate features of the present invention will be described. In this embodiment the receptacle 100 generally comprises a housing 102 and a module assembly 104 connected to the housing 102. The housing 102 generally comprises a first housing member 106 and a second housing member 108. The first and second housing members 106, 108 are preferably comprised of a dielectric material, such as a molded plastic or polymer material. The first housing member 106 includes a top 110, a back 112, two sides 114, a generally open front, a generally open bottom, and a receiving area 120. The top 110 includes module mounting holes 122. The back 112 includes module mounting holes 124. The front includes extensions from the sides 114 for insertion into and connection with the second housing member 108. The second housing member 108 includes apertures or lead-ins through a front face 130 for insertion of front ends of a mating connector's male pins into the connector 100.

Figure 8A:
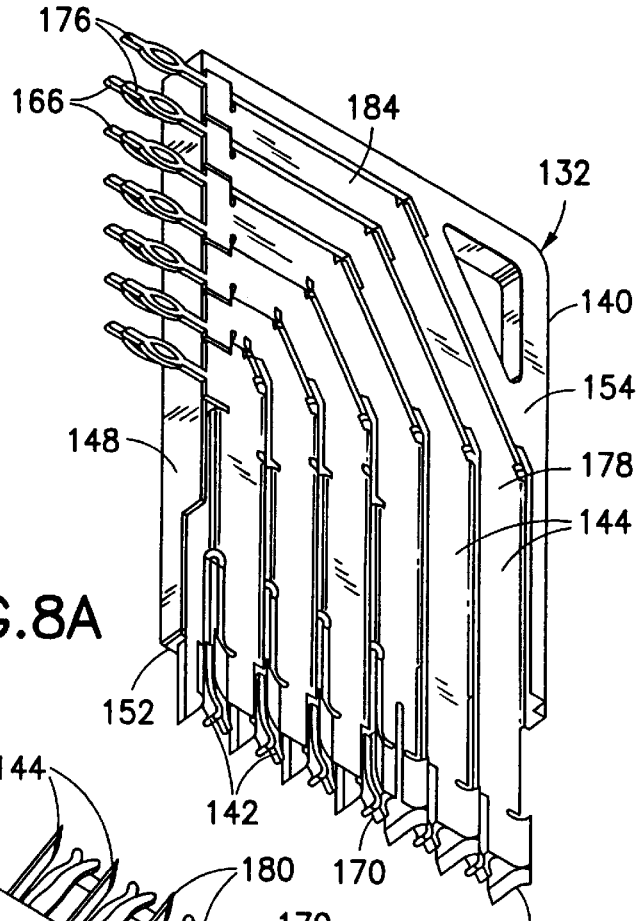
FIGS. 8A and 8B are perspective views of a module having the contact shown in FIG. 1 and used to form the connector shown in FIG. 7.
Figure 8B:
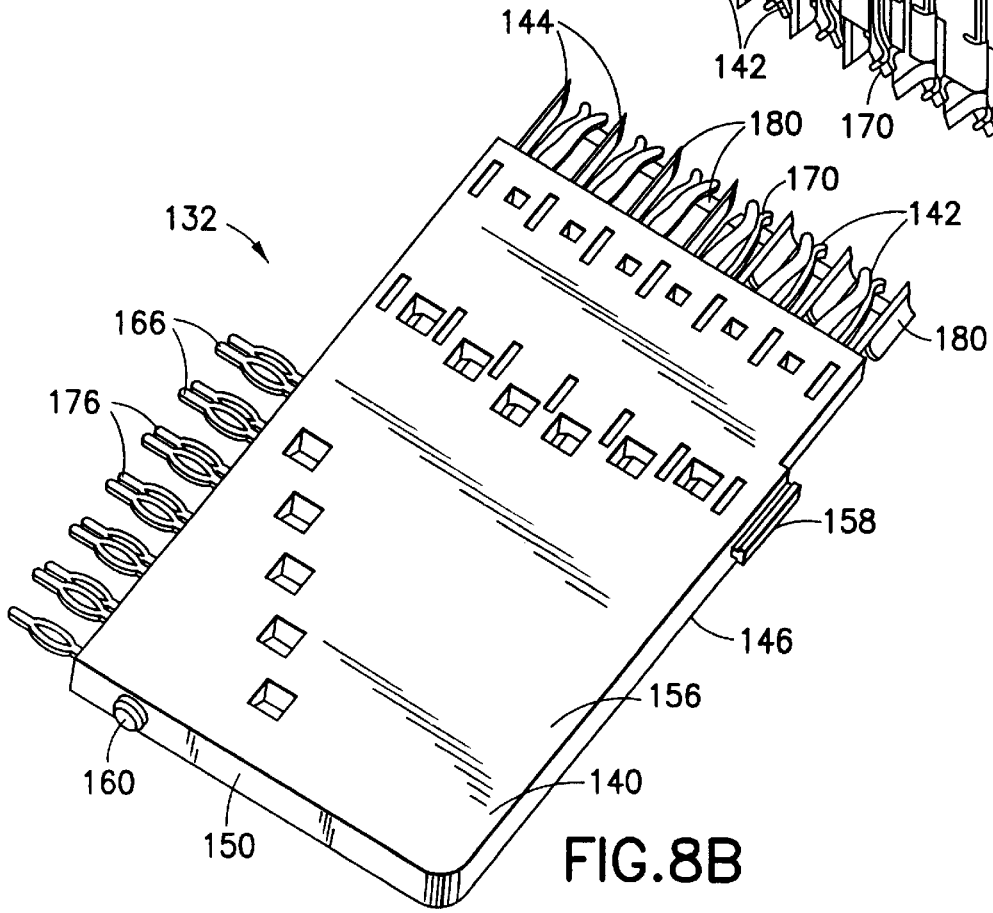

The module assembly 104, in this embodiment, generally comprises six contact modules 132 (one of which is shown in FIG. 8A) and may include an additional ground member (not shown). In alternate embodiments more or less than six contact modules could be provided and, more or less than one ground member could be provided. In this embodiment the contact modules 132 comprise two sets of two types of contact modules which are preferably mirror images of each other. The ground member is sandwiched between the two sets. Each contact module 132 generally comprises a frame 140, signal contacts 142, and ground contacts 144. The frame 140 is preferably comprised of dielectric material, such as molded plastic or polymer. The frame 140 comprises a top side 146, a bottom side 148, a rear side 150, a front side 152, and two lateral sides 154, 156. The top side 146 includes a latch 158. The latch 158 is inserted into one of the module mounting holes 122 to connect the contact module 132 to the first housing member 106. The rear side 150 also includes a projection 160. The projection 160 is inserted into one of the module mounting holes 124 to connect the module 132 to the first housing member 106. The frame 140 includes channels 162 along at least one of the sides 154 for receiving portions of the ground contacts 144. The frame 140 could also have channels for receiving portions of the signal contacts 142. However, the frame 140 is preferably over-molded onto portions of the signal contacts 142. Alternatively, or additionally, the frame 140 could be over-molded onto portions of the ground contacts 144. The front side 152 of the frame 140 includes pockets 164 and receiving area 165.

Figure 8C:
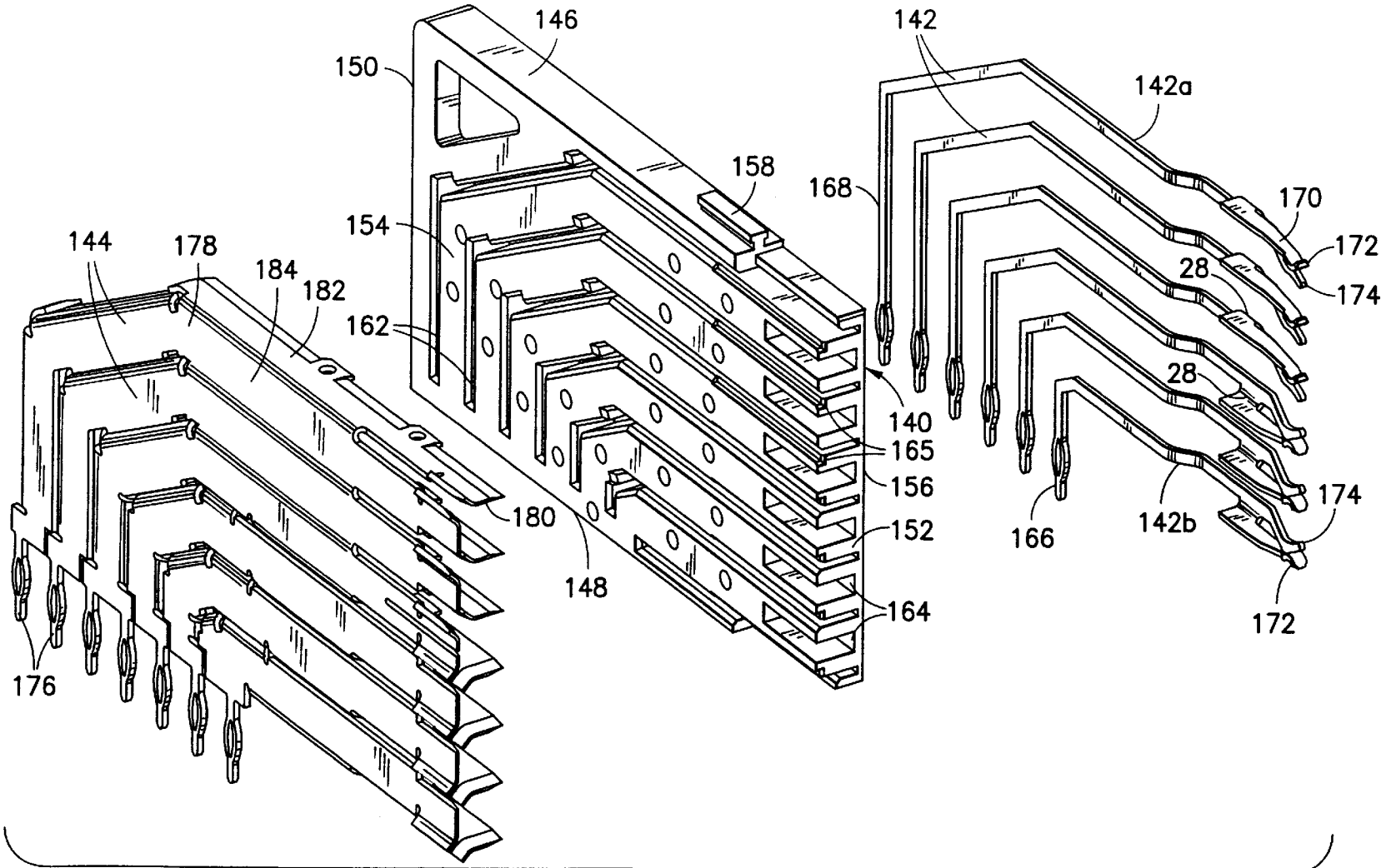
FIG. 8C is an exploded perspective view of the module shown in FIGS. 8A and 8B.

In this embodiment each contact module has six of the signal contacts 142; three as a first type 142*a* of signal contacts and three as a second type 142*b* of signal contacts. The signal contacts 142 each have a first end 166, a middle section 168, and a second end 170. The first ends 166 have through-hole solder tails, but any suitable first ends could be provided, such as surface mount solder tails. The middle sections 168 all have right turn shapes, but with different lengths or dimensions to allow the signal contacts to be aligned in a row or common plane. The second ends 170 each comprise two deflectable arms 172, 174 oriented 90° offset from each other. The arms 172, 174 in the first type of signal contact 142*a* are orientated as mirror images of the arms 172, 174 in the second type of signal contacts 142*b*. The signal contacts 142 generally incorporate features of the contact 10. More specifically, the second ends 170 are structured similar to the second connection section 14 with the arms 172, 174 corresponding to the arms 18, 20. The signal contacts 142 can have the bend 28 in the upper left hand corner, the upper right hand corner, the lower left hand corner or the lower right hand corner of the second ends 170. Preferably the arms 172 (equivalent to arm 20) are located on only the top or bottom of the second ends 170 (as illustrated in FIG. 8C) and the arms 174 (equivalent to arm 18) extend from either the right side or the left side depending upon which one of the six contact modules 132 they are in. In alternate embodiments other types or orientations of the second ends could be provided.

The ground contacts 144 for each module 132 can be provided as a single one-piece member or multiple members as shown. Each ground contact 144 includes a first end 176, a middle section 178, and a second end 180. The first ends 176 have through-hole solder tails. However, any suitable types of first ends could be provided, such as surface mount solder tails. The middle sections 178 generally comprise first sections 182 and second sections 184. The first sections 182 are located in the slots 162 of the frame 104 to fixedly connect the ground contacts 144 to the frame 140. The second sections 184 extend along the side surfaces 154 of the frame 140. The middle sections 178 have a general right turn shape such that the two ends 176, 180 are at a general right angle to each other. However, any suitable shape of the middle sections could be provided. The second ends 180 include three different types of second ends. The first type of second end has a slot at a corner with a top arm and a side arm on opposite sides of the slot. The deflectable projections extend from the arms. The second type of second end is generally a mirror image of the first type of second end. The third type of end has two slots at two corners with a top arm, a bottom arm and a side arm. Two deflectable projections extend into the first slot, and two deflectable projections extend into the second slot. The side arm also includes a third slot. However, in alternate embodiments, any suitable type(s) of second ends could be provided.

Figure 8D:
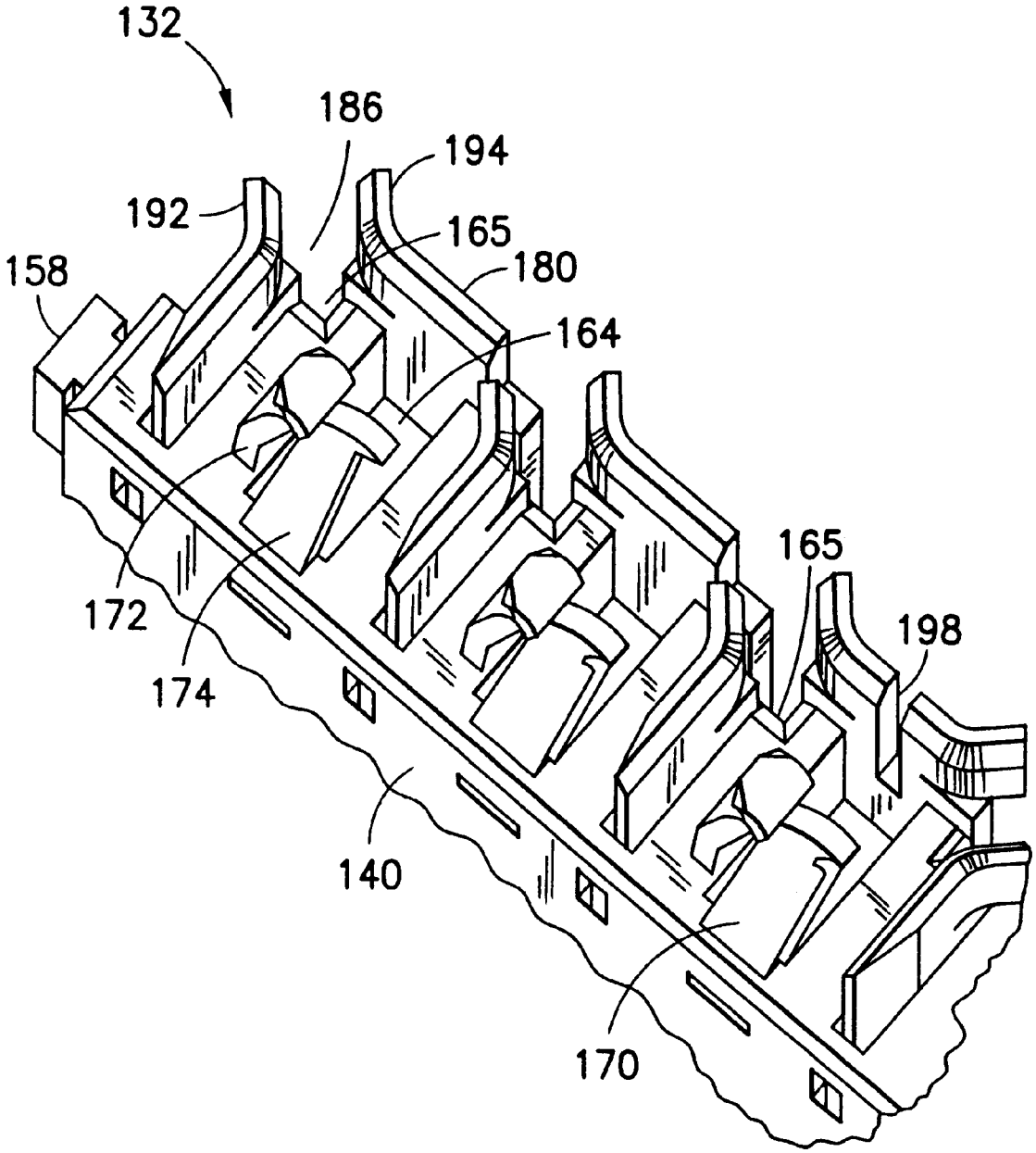
FIG. 8D is a partial enlarged perspective view of one corner of the module shown in FIGS. 8A and 8B.

Referring now also to FIG. 8D, a partial enlarged view of the front end of one of the modules 132 is shown. The two arms 172, 174 of each second end 170 of the signal contacts 142 are located in front of one of the pockets 164. A signal pin from a mating connector, when inserted through one of the lead-ins of the housing, extends between the two arms 172, 174 into the pocket 164. The arms 172, 174 resiliently deflect outward. The slots 186 of the ground contacts 144 are located at the receiving areas 165 of the modules' frame 140. A ground pin from the mating connector can extend into the slot 186 and receiving area 165 between the two projections 192, 194. When the module assembly 104 is assembly the ground contacts 144 and the ground member 134 combine to effectively surround the signal contacts to form an electromagnetic shielding for the signal contacts. The ground member 134 also has a front end for connection to ground pins from the mating connector.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical contact comprising:

a base;

a first contact arm extending from the base in a forward direction in a general cantilever fashion, the first contact arm having a first contact area; and a second contact arm extending from the base in the forward direction in a general cantilever fashion, the second contact arm having a second contact area, wherein the first and second contact arms form a male contact receiving area therebetween, wherein the first and second contact arms are generally transverse to each other with a relatively narrow side edge of the first contact arm forming the first contact area and facing a relatively wide side face of the second contact arm which forms the second contact area, wherein the first and second contact areas are at least partially longitudinally offset from each other along a path of insertion of a male contact into the male contact receiving area, and wherein the first and second contact areas overlap in a direction through the path of insertion of the male contact.

2. An electrical contact as in claim 1 wherein the first and second contact arms are integrally connected to each other and formed from a flat conductive member.

3. An electrical contact as in claim 1 wherein the first and second arms form a general cross-sectional "T" shape proximate their first and second contact areas before a male contact is inserted into the male contact receiving area.

4. An electrical contact as in claim 1 wherein the side edge of the first contact arm forming the first contact area comprises a protrusion.

5. An electrical contact as in claim 4 wherein the second contact arm has a curved shape along the second contact area.

6. An electrical contact as in claim 5 wherein a front of the side edge of the first contact arm has a sloped surface leading to the protrusion and wherein the second contact area contacts the sloped surface.

7. An electrical contact as in claim 1 wherein the first and second contact arms are sized and shaped such that insertion of a male contact having a substantially uniform width into the male contact receiving area moves the contact areas a distance larger than the width of the male contact.

8. An electrical contact as in claim 1 wherein the first and second contact arms are generally orthogonal to each other.

9. An electrical connector comprising:

a housing; and an electrical contact as recited in claim 1 connected to the housing.

10. An electrical contact comprising:

a first connection section for connection to a first electrical component; and a second connection section, connected to the first connection section, for connection to a second electrical component, the second connection section comprising two contact arms forming a male contact receiving area therebetween, the two contact arms each having a male contact contacting area which are longitudinally offset from each other along a path of insertion of the male contact into the contact receiving area and the contact areas are generally transverse to each other for contacting orthogonal surfaces of the male contact and, before the male contact is inserted into the contact receiving area, the two contacting areas overlap each other through the path of insertion of the male contact.

11. An electrical contact as in claim 10 wherein the first connection section comprises a press-fit insertion through-hole solder tail.

12. An electrical contact as in claim 10 wherein the two contact arms are arranged generally orthogonal to each other.

13. An electrical contact as in claim 10 wherein the two contacting areas are longitudinally offset from each other along the path of insertion of the male contact into the male contact receiving area.

14. An electrical contact as in claim 10 wherein the first and second contact arms are integrally connected to each other and formed from a flat conductive member.

15. An electrical contact as in claim 10 wherein the two contact arms form a general cross-sectional "T" shape proximate their contacting areas before a male contact is inserted into the male receiving area.

16. An electrical contact as in claim 10 wherein a relatively narrow side edge of a first one of the contact arms forms the contacting area for the first contact arm and comprises a protrusion.

17. An electrical contact as in claim 16 wherein a second one of the contact arms has a curved shape along the contact area of the second contact arm.

18. An electrical contact as in claim 17 wherein a front of the side edge of the first contact arm has a sloped surface leading to the protrusion and wherein the contacting area of the second contact arm contacts the sloped surface.

19. An electrical contact as in claim 10 wherein the contact arms are sized and shaped such that insertion of a male contact having a substantially uniform width into the male contact receiving area moves the contact areas a distance larger than the width of the male contact.

* * * * *